US011408432B2

(12) United States Patent
Watson

(10) Patent No.: US 11,408,432 B2
(45) Date of Patent: Aug. 9, 2022

(54) SUBMERSIBLE PUMPING SYSTEM WITH A MOTOR PROTECTOR HAVING A THRUST RUNNER, RETENTION SYSTEM, AND PASSAGEWAY ALLOWING GAS FLOW FROM A LOWER REGION INTO AN UPPER REGION

(71) Applicant: SCHLUMBERGER TECHNOLOGY CORPORATION, Sugar Land, TX (US)

(72) Inventor: Arthur Ignatius Watson, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 569 days.

(21) Appl. No.: 15/767,152

(22) PCT Filed: Oct. 4, 2016

(86) PCT No.: PCT/US2016/055242
§ 371 (c)(1),
(2) Date: Apr. 10, 2018

(87) PCT Pub. No.: WO2017/066032
PCT Pub. Date: Apr. 20, 2017

(65) Prior Publication Data

US 2018/0298910 A1 Oct. 18, 2018

Related U.S. Application Data

(60) Provisional application No. 62/239,958, filed on Oct. 11, 2015.

(51) Int. Cl.
*F04D 29/041* (2006.01)
*F04D 13/10* (2006.01)

(52) U.S. Cl.
CPC ..... *F04D 29/0413* (2013.01); *F04D 13/10* (2013.01)

(58) Field of Classification Search
CPC ..... F16C 32/06; F16C 17/042; F16C 17/04; F16C 32/0666; F16C 17/10; F16C 17/107; F04D 29/041; F04D 29/051; F04D 29/053
(Continued)

(56) References Cited

U.S. PATENT DOCUMENTS 2,363,420 A * 11/1944 Giles ..... F04D 29/126 417/423.3
3,384,769 A 5/1968 Schaefer
(Continued)

FOREIGN PATENT DOCUMENTS

KR 10-0364407 B1 12/2002
WO 2015178887 A1 11/2015
WO 2016053588 A1 4/2016

OTHER PUBLICATIONS

International Search Report and Written Opinion for corresponding PCT/US2016/055242, dated Dec. 14, 2016, 15 pages.
(Continued)

*Primary Examiner* — Devon C Kramer
*Assistant Examiner* — Benjamin Doyle

(57) ABSTRACT

A system and methodology are provided for enhancing the life and usefulness of a thrust bearing assembly in a submersible pumping system component. The technique utilizes a thrust runner positioned adjacent a thrust bearing in the submersible pumping system component. The thrust runner is rotated relative to the thrust bearing via a shaft. Gas that may accumulate in a lower region beneath the thrust runner is vented through a passageway from the lower region to an upper region above the thrust runner. The gas is vented to
(Continued)

help maintain a hydrodynamic fluid film between the thrust runner and the thrust bearing.

14 Claims, 4 Drawing Sheets

(58) Field of Classification Search
USPC ..... 417/423.3
See application file for complete search history.

(56) References Cited

U.S. PATENT DOCUMENTS 3,404,924 A * 10/1968 Choate ..... F04D 29/0462 384/149
3,718,379 A * 2/1973 Leckenby ..... F16C 17/02 384/113
3,867,056 A 2/1975 Carle et al.
4,362,020 A * 12/1982 Meacher ..... F01D 25/22 290/52
4,477,235 A * 10/1984 Gilmer ..... H02K 5/132 417/414
4,792,296 A * 12/1988 Kobayashi ..... F04C 29/023 418/55.6
4,798,476 A * 1/1989 Sakatani ..... F16C 17/026 384/108
4,805,972 A * 2/1989 Tanaka ..... F16C 17/026 310/90
5,160,240 A * 11/1992 Wilson ..... F04D 13/10 415/170.1
5,207,810 A 5/1993 Sheth
6,246,136 B1 * 6/2001 Ichiyama ..... G11B 19/20 310/90
6,345,968 B1 * 2/2002 Shupe ..... F04C 2/104 418/104
6,361,214 B1 * 3/2002 Ichiyama ..... F16C 17/107 384/107
6,524,006 B1 * 2/2003 Lee ..... F16C 17/045 384/107
6,929,064 B1 * 8/2005 Susman ..... F04C 2/3447 166/105
7,819,644 B2 * 10/2010 Eber ..... F04C 18/0215 418/55.1
8,016,571 B2 * 9/2011 Speer ..... F04D 1/063 417/365
8,684,679 B2 * 4/2014 Tetzlaff ..... F04D 13/10 415/170.1
8,807,966 B2 8/2014 Du et al.
8,932,034 B2 * 1/2015 McKinney ..... F04D 29/106 417/414
2001/0001269 A1 * 5/2001 Asai ..... G11B 19/2009 384/100
2005/0087343 A1 * 4/2005 Du ..... F04D 13/021 166/369
2005/0109515 A1 * 5/2005 Watson ..... E21B 43/128 166/369
2006/0204359 A1 9/2006 Semple et al.
2009/0010773 A1 1/2009 Parmeter et al.
2010/0258306 A1 10/2010 Camilleri et al.
2010/0321823 A1 12/2010 Oe et al.
2012/0257998 A1 * 10/2012 Parmeter ..... F04B 53/18 417/423.13
2012/0263610 A1 * 10/2012 Tetzlaff ..... F04D 29/0413 417/410.1
2014/0219825 A1 8/2014 Santos et al.
2014/0307989 A1 * 10/2014 Leuthold ..... G11B 5/59638 384/123
2015/0023815 A1 * 1/2015 Tetzlaff ..... F04D 29/0413 417/365
2015/0184671 A1 * 7/2015 Parmeter ..... F04D 7/04 415/111
2015/0188384 A1 * 7/2015 Rumbaugh ..... H02K 5/167 310/90
2015/0211527 A1 * 7/2015 St. John ..... F04D 13/086 417/423.3
2016/0133431 A1 * 5/2016 Hunt ..... H01J 35/105 378/132
2017/0037861 A1 * 2/2017 Rutter ..... F04D 3/02
2017/0130730 A1 * 5/2017 Torkildsen ..... F04D 29/0516
2017/0167498 A1 * 6/2017 Chang ..... F04D 1/063
2017/0260990 A1 9/2017 Pyron et al.
2018/0298910 A1 * 10/2018 Watson ..... F04D 29/0413
2019/0271324 A1 * 9/2019 Watson ..... F04D 13/10

OTHER PUBLICATIONS

International Preliminary Report on Patentability issued in the PCT Application PCT/US2016/055242, dated Apr. 17, 2018 (11 pages).
International Search Report and Written Opinion issued in the PCT Application PCT/US2017/057777, dated Feb. 7, 2018 (18 pages).
International Preliminary Report on Patentability issued in the PCT Application PCT/US2017/057777, dated Apr. 23, 2019 (14 pages).
Office Action issued in the U.S. Appl. No. 16/344,290, dated Dec. 22, 2020 (25 pages).

* cited by examiner

SUBMERSIBLE PUMPING SYSTEM WITH A MOTOR PROTECTOR HAVING A THRUST RUNNER, RETENTION SYSTEM, AND PASSAGEWAY ALLOWING GAS FLOW FROM A LOWER REGION INTO AN UPPER REGION

CROSS-REFERENCE TO RELATED APPLICATION

The present document is based on and claims priority to U.S. Provisional Application Ser. No. 62/239,958 filed Oct. 11, 2015, which is incorporated herein by reference in its entirety.

BACKGROUND

Electric submersible pumping (ESP) systems are used in a variety of well related applications and often comprise a submersible pump powered by a submersible motor which is protected by a motor protector, e.g. a seal section. The traditional motor protector is located between the submersible pump and the submersible motor. The motor protector includes chambers which combine the functions of compensating for thermal expansion and contraction of motor oil, discharging motor oil into the well when the volume of motor oil exceeds the motor's capacity due to thermal expansion, and sealing of an internal driveshaft against leakage. The motor protector comprises a thrust chamber assembly to carry axial thrust loads generated by operation of the submersible pump and by the weight of a rotating pumping assembly of the pump. Additionally, the submersible motor may comprise a thrust chamber assembly to carry the weight of the motor shaft and rotors. In some systems, the shaft of the protector and the shaft of the motor are rigidly joined and one thrust chamber is used to carry the entire thrust load as well as the weight of the shafts and internal assemblies supported by the shafts.

Generally, a thrust chamber assembly comprises a thrust runner and a thrust bearing. The thrust runner is rotationally and axially affixed to the corresponding shaft, e.g. the motor protector shaft or the submersible motor shaft, and may be in the form of a thick disk with flat upper and lower faces. The thrust runner rotates against a stationary thrust bearing. A hydrodynamic fluid film of motor oil is generated between the thrust runner and the bearing support areas of the thrust bearing so as to support the thrust runner without excessive contact or wear between the thrust runner and the thrust bearing. The effectiveness of the fluid film depends on adequate viscosity and lubricity of the motor oil with which the motor protector and submersible motor are filled. During operation of the electric submersible pumping system, however, gas bubbles may be present in the motor oil. The gas may be from a variety of sources, e.g. residual air from incomplete oil filling, dissolved gas that is liberated from the oil by agitation of the motor oil (or by changes in pressure or temperature), and/or gasification of components of the motor oil. Gas between the thrust runner and the thrust bearing enables contact therebetween which can lead to excessive wear.

SUMMARY

In general, a system and methodology are provided for enhancing the life and usefulness of a thrust bearing assembly in a submersible pumping system component. The technique utilizes a thrust runner positioned adjacent a thrust bearing in the submersible pumping system component. The thrust runner is rotated relative to the thrust bearing via a shaft. Gas that may accumulate in a lower region beneath the thrust runner is vented through a passageway from the lower region to an upper region above the thrust runner to help maintain a hydrodynamic fluid film between the thrust runner and the thrust bearing.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
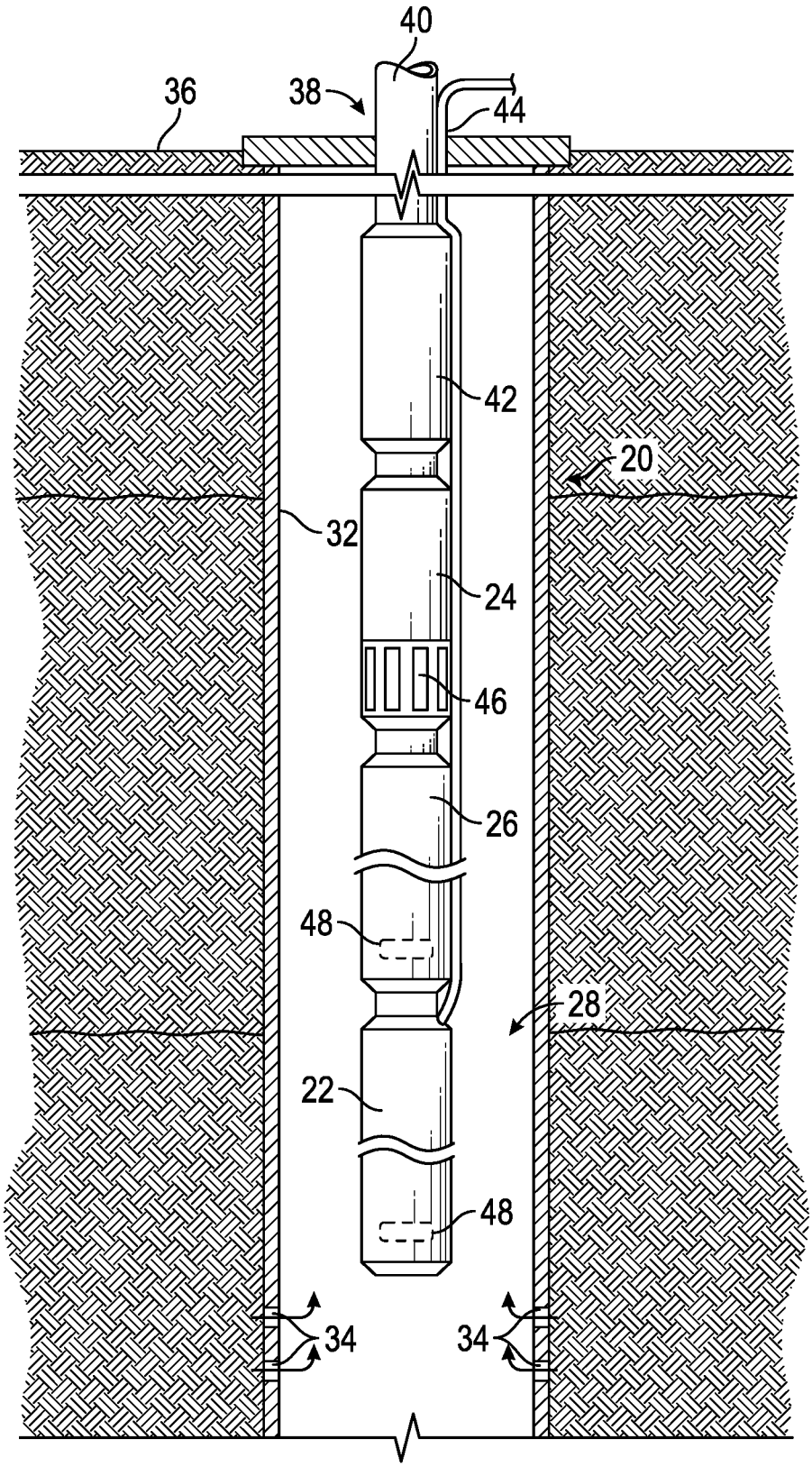
FIG. 1 is an illustration of an electric submersible pumping system disposed in a borehole, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

Embodiments described herein provide a system and methodology which are able to enhance the life and usefulness of a thrust bearing assembly in a submersible pumping system component. The system and methodology facilitate the venting of gas which could otherwise lead to excess wear and potential failure of thrust bearing system components.

Embodiments described herein may utilize a thrust runner positioned adjacent a thrust bearing in the submersible pumping system component. For example, the thrust runner and thrust bearing may be part of a thrust bearing system in a submersible motor and/or motor protector. The thrust bearing may generally be located beneath the thrust runner and the thrust runner may be rotated relative to the thrust bearing via a shaft. Gas that may accumulate in a lower region beneath the thrust runner is vented through a passageway from the lower region to an upper region above the thrust runner to help maintain a hydrodynamic fluid film between the thrust runner and the thrust bearing. It should be noted the terms upper/upward/above and lower/downward/beneath refer to relative positions along the wellbore. In a non-vertical wellbore, for example, the direction leading toward the surface of the earth is the upper/upward/above direction and the direction leading away from the surface of the earth is the lower/downward/beneath direction.

The venting capability protects against gas bubbles which can arise in motor oil of an electric submersible pumping system, e.g. within a submersible motor or motor protector. If gas bubbles are rising during operation of the electric submersible pumping system, the gas can become trapped in the thrust bearing assembly under a thrust runner unless vented as described herein. One reason gas bubbles become trapped under the thrust runner is that centrifugal forces resist travel of the gas radially outwardly and around an outer diameter of the thrust runner.

While the shaft and the thrust runner are rapidly rotating with respect to the thrust bearing, centrifugal separation of gas from liquid occurs. The liquid motor oil is segregated outwardly to an inner diameter of the surrounding component housing while the gas is segregated inwardly to a region surrounding the shaft. As the layer of gas builds up around the shaft it may invade the region between the thrust runner and the thrust bearing and ultimately displace the motor oil therebetween. Loss of the oil film between the thrust runner and the thrust bearing can cause friction damage to the bearing surfaces, but the venting passageway or passageways may be used to remove this gas and to protect the oil film.

Damage to the thrust bearing components or failure of those components may occur in a variety of operational situations unless the detrimental gas is properly vented. For example, the damage or failure may occur while testing electric submersible pumping systems in test wells before shipping them to the field. Because test wells generally are not pressurized other than by submergence of the electric submersible pumping system, air pockets remaining in the equipment due to imperfect filling are not readily dissolved in the motor oil. However, damage due to the gas invasion between thrust bearing and thrust runner can be difficult to detect. While in the field, damage may eventually escalate to cause thrust bearing failure without leaving evidence as to the root cause.

Furthermore, the possibility of gas damage tends to be discounted as the root cause of field failure because the elevated well pressure dissolves small atmospheric air bubbles. However, well gases can temporarily dissolve into the motor oil during periods of higher pressure, e.g. shut down. When the well pressure is subsequently drawn down as a result of pumping, gas can be liberated throughout the motor oil and may rise into the thrust chamber of the thrust bearing system. Additionally, components of the motor oil itself can gasify over time at elevated temperatures. The resulting gas can gradually rise and accumulate in the lower region under the thrust runner without proper venting.

According to embodiments described herein, a system and methodology are provided for venting gas that would otherwise be trapped under a thrust runner. In some embodiments, passageways, e.g. axial passageways, near an outer surface of the shaft may be used to route trapped gas upwardly from a lower region below the thrust runner to an upper region above the thrust runner. This venting prevents the gas from continually increasing and invading the bearing interface between the thrust runner and the thrust bearing.

In some embodiments, the venting passageway or passageways may take the form of holes through the runner near its inner diameter about the shaft. In other examples, the passageway may be in the form of channels along a bore of the thrust runner or channels in an outer surface of the shaft. The passageway also may comprise interconnecting holes formed through the shaft from the region below the thrust runner to the region above the thrust runner. The venting passageway also may have other configurations, including canted passageways which are angled with respect to the axial direction to promote flow of gas up through the thrust runner. The passageway or passageways also may be helical in shape or otherwise curvilinear to similarly facilitate movement of the gas up through the thrust runner. In some embodiments, the passageway may comprise or work in cooperation with pumping features, such as eccentric openings, angled openings, scoops, or other features which facilitate the pumping action and flow of gas from the lower region to the upper region. In addition to venting gas, the passageways described herein also increase the flow of oil heated by shearing in the thrust bearing. The passageways enable flow of the heated oil to a region above the thrust runner, thus transferring heat away from the bearing. As a result, the bearing is able to run at a lower temperature which maintains the viscosity and lubricity of the oil.

Referring generally to FIG. 1, an embodiment of a submersible pumping system 20, e.g. an electric submersible pumping system, is illustrated. The submersible pumping system 20 may comprise a variety of components depending on the particular application or environment in which it is operated. In the example illustrated, the pumping system 20 is in the form of an electric submersible pumping system comprising a submersible motor 22, a submersible pump 24 powered by the submersible motor 22, and a motor protector 26.

As illustrated, the electric submersible pumping system 20 may be deployed in a borehole 28, e.g. a wellbore, drilled in a geologic formation 30. The geologic formation 30 may contain desirable production fluids, such as petroleum. In well applications, the borehole 28 may be lined with a wellbore casing 32 and a plurality of perforations 34 may be formed through the wellbore casing 32 and out into the geologic formation 30. The perforations 34 facilitate the flow of fluids, e.g. production fluids, from the formation 30 and into borehole 28 for pumping via submersible pumping system 20.

The submersible pumping system 20 may be deployed downhole from a surface location 36 via a conveyance 38. By way of example, the conveyance 38 may comprise tubing 40, e.g. production tubing or coiled tubing, coupled to submersible pumping system 20 via a connector 42. Electric power may be provided to submersible motor 22 through a power cable 44. When submersible motor 22 is electrically powered, the submersible motor 22 operates to power submersible pump 24, e.g. a centrifugal pump, which then draws in fluid from borehole 28 through a pump intake 46. In the example illustrated, the fluid drawn in through pump intake 46 is pumped via submersible pump 24 upwardly through tubing 40 to a desired surface collection location or other collection location.

During operation of submersible pump 24, the pumping of fluids upwardly through tubing 40 can place substantial axial loading on the system of shafts and couplings by which submersible motor 22 drives submersible pump 24. The system of shafts and couplings extends from submersible pump 24 down through motor protector 26 and into or through submersible motor 22. This axial loading is carried by at least one thrust bearing system 48 which may be located in motor protector 26. The submersible motor 22 also may comprise at least one thrust bearing system 48 to carry the weight of, for example, the shaft and rotors within submersible motor 22. Each thrust bearing system 48 comprises a thrust runner mounted on the shaft and a thrust bearing located in a thrust chamber, as described in greater detail below.

Figure 2:
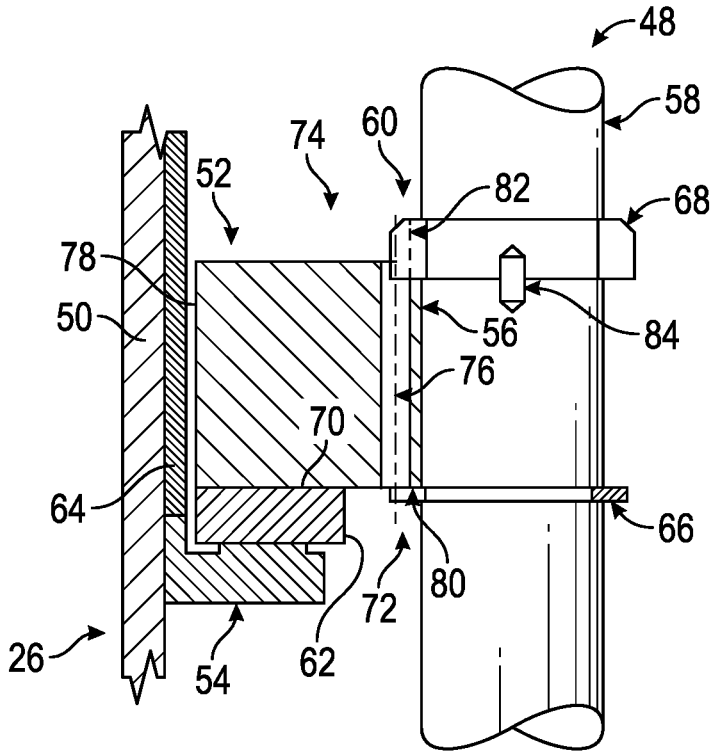
FIG. 2 is a partial cross-sectional view of a thrust bearing system for use in a submersible pumping system component, according to an embodiment of the disclosure.

Referring generally to FIG. 2, an embodiment of thrust bearing system 48 is partially illustrated in cross-section. In this example, the thrust bearing system 48 is illustrated as deployed in a submersible pumping system component, and specifically in motor protector 26. However, the thrust bearing system 48 also may be employed in submersible motor 22 or in other suitable submersible pumping system components. As illustrated, the motor protector 26 (or other submersible pumping system component) has an outer housing 50 which creates a thrust bearing chamber 52 for receiving the thrust bearing system 48.

In the embodiment illustrated, the thrust bearing system 48 comprises a thrust bearing 54, a thrust runner 56, a shaft 58, and a retention system 60 used to securely lock thrust runner 56 to shaft 58. The thrust bearing 54 may have various configurations, including the illustrated configuration in which the thrust bearing 54 comprises a thrust bearing pad 62 positioned to engage thrust runner 56. The thrust bearing 54 also may comprise a mounting structure 64 by which the thrust bearing 54 is secured to housing 50. For example, the thrust bearing 54 may be coupled with housing 50 via threaded engagement, spacers, pins, clips, fasteners, or other suitable mounting features.

The thrust runner 56 is rotationally and axially coupled to shaft 58 for rotation with shaft 58. The retention system 60 may comprise a variety of components for coupling thrust runner 56 to shaft 58, but one embodiment utilizes a retainer ring 66 on a lower side of the thrust runner 56 and a two-piece ring 68 on an upper side of the thrust runner 56. The two-piece ring 68 axially locks the thrust runner 56 to the shaft 58 and cooperates with the retainer ring 66 to hold the thrust runner 56 at the desired axial position along shaft 58. It should be noted that shaft 58 may be constructed with a plurality of shaft sections coupled together and extending from submersible motor 22 to at least submersible pump 24.

Prior to operation, the submersible motor 22 and motor protector 26, including thrust bearing chamber 52, are filled with a motor oil. The motor oil may perform a variety of functions including establishing a hydrodynamic fluid film at an interface 70 between thrust bearing 54, e.g. thrust pad 62, and thrust runner 56. The hydrodynamic fluid film enables rotation of thrust runner 56 relative to thrust bearing 54 without undue wear. As described above, however, gas bubbles may form in or migrate into thrust bearing system 48 and may migrate into a lower region 72 beneath thrust runner 56. If a sufficient amount of gas builds up in lower region 72, the gas can invade into the interface 70 and cause damage or failure as thrust runner 56 is rotated with respect to thrust bearing 54.

In the embodiment illustrated, gas that may build up is vented out of the lower region 72 and to a less harmful location, such as an upper region 74 located above the thrust runner 56. The gas is vented from the lower region 72 to the upper region 74 via a passageway 76 disposed within an outer surface 78 of the thrust runner 56. As illustrated, the outer surface 78 may be the outer circumferential surface of the thrust runner 56. In some applications, the gas may further be vented from upper region 74 to another location in the submersible pumping system 20 and/or to a wellbore annulus surrounding the submersible pumping system 20.

The passageway 76 may be routed along a variety of pathways in various positions, orientations, and patterns. Additionally, the passageway 76 may comprise a single passageway or a plurality of passageways between lower region 72 and upper region 74. In many applications, the passageway 76 comprises a plurality of passageways disposed at or proximate shaft 58. The central location of passageway 76 is useful because centrifugal separation moves gas toward the central location of shaft 58 during operation of thrust bearing system 48.

In the example illustrated in FIG. 2, the passageway 76 comprises at least one passageway disposed through thrust runner 56 in an axial direction from lower region 72 to upper region 74. The retainer ring 66 and the two-piece ring 68 may be formed with recesses or gaps 80, 82, respectively, to avoid blocking the free flow of gas from lower region 72 to upper region 74. In some applications, a pin 84 or other suitable retention member may be used to secure the two-piece ring 68 at a desired rotational position to maintain alignment of passageway 76 with gap 82. A similar retention member may be used to hold retainer ring 66 in the desired rotational position. During operation of thrust bearing system 48, the gas that may accumulate in lower region 72 is thus provided with a vent path via passageway 76 to a less problematic region, e.g. upper region 74.

Figure 3:
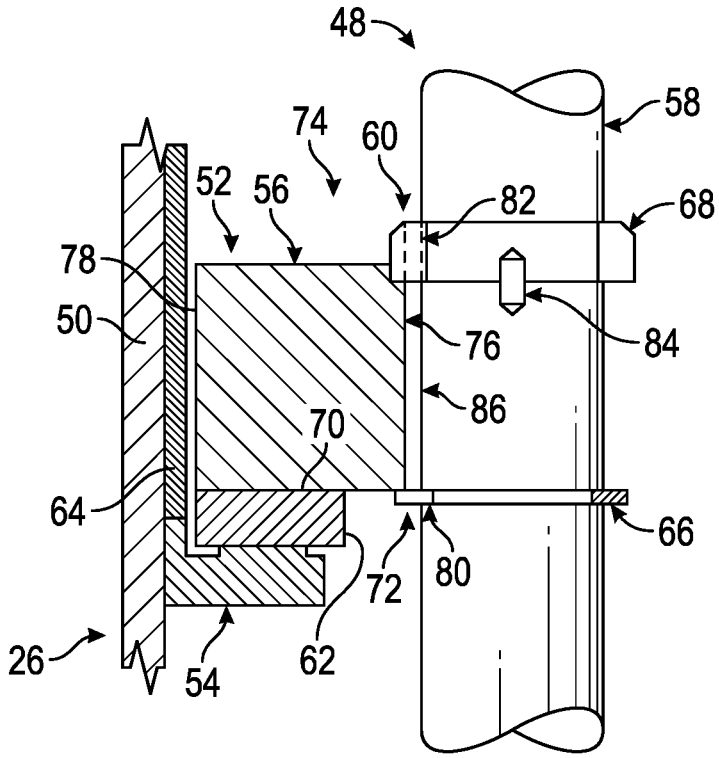
FIG. 3 is a partial cross-sectional view of another example of a thrust bearing system for use in a submersible pumping system component, according to an embodiment of the disclosure.

Referring generally to FIG. 3, another embodiment of thrust bearing system 48 is illustrated. In this example, at least one passageway 76 is in the form of a channel disposed along an inside surface 86 of the thrust runner 56. The inside surface 86 is the surface defining the bore which receives shaft 58, and thus the passageway 76 is effectively positioned between the thrust runner 56 and the shaft 58. The passageway 76 may be oriented in an axial direction, i.e. parallel with the axis of shaft 58, or the passageway 76 may be canted with respect to the axis of shaft 58, e.g. helically canted. Additionally, the passageway 76 may comprise a single channel or a plurality of channels having desired cross-sectional configurations. For example, each channel of passageway 76 may be in the form of a rectangular groove such as a keyway or other type of groove with a rounded bottom. The gaps 80, 82 may similarly be located in retainer ring 66 and two-piece ring 68 to facilitate the flow of gas from lower region 72 to upper region 74.

Figure 4:
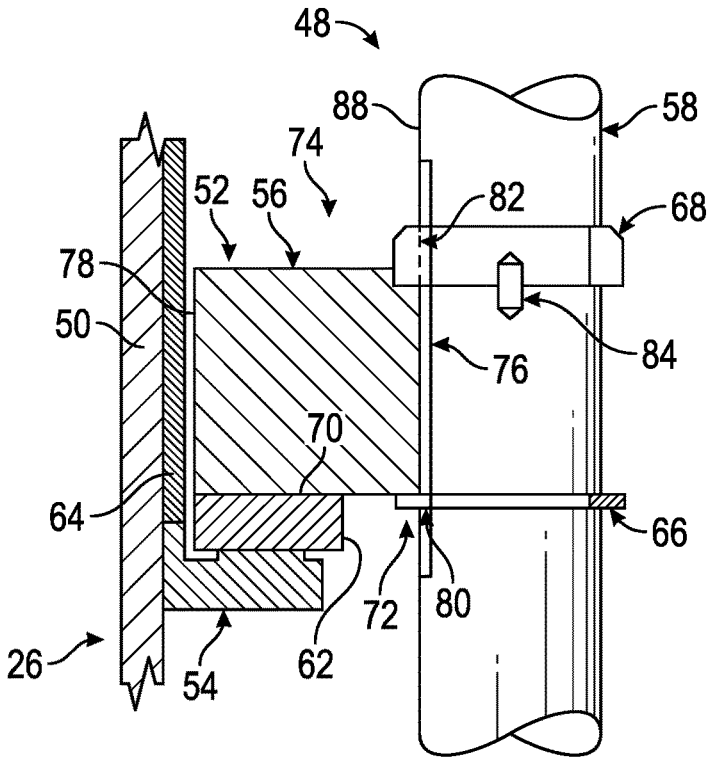
FIG. 4 is a partial cross-sectional view of another example of a thrust bearing system for use in a submersible pumping system component, according to an embodiment of the disclosure.

Referring generally to FIG. 4, another embodiment of thrust bearing system 48 is illustrated. In this example, at least one passageway 76 is in the form of a channel disposed along an outside surface 88 of the shaft 58. Again, the passageway 76 is effectively positioned between the thrust runner 56 and the shaft 58. The passageway 76 along outside surface 88 may be axial and parallel with the axis of shaft 58 or the passageway 76 may be canted with respect to the axis of shaft 58, e.g. helically canted. Additionally, the passageway 76 may comprise a single channel or a plurality of channels having desired cross-sectional configurations. For example, each channel of passageway 76 may be in the form of a rectangular groove such as a keyway or other type of groove with a rounded bottom. The gaps 80, 82 may similarly be located in retainer ring 66 and two-piece ring 68 to facilitate the flow of gas from lower region 72 to upper region 74.

Figure 5:
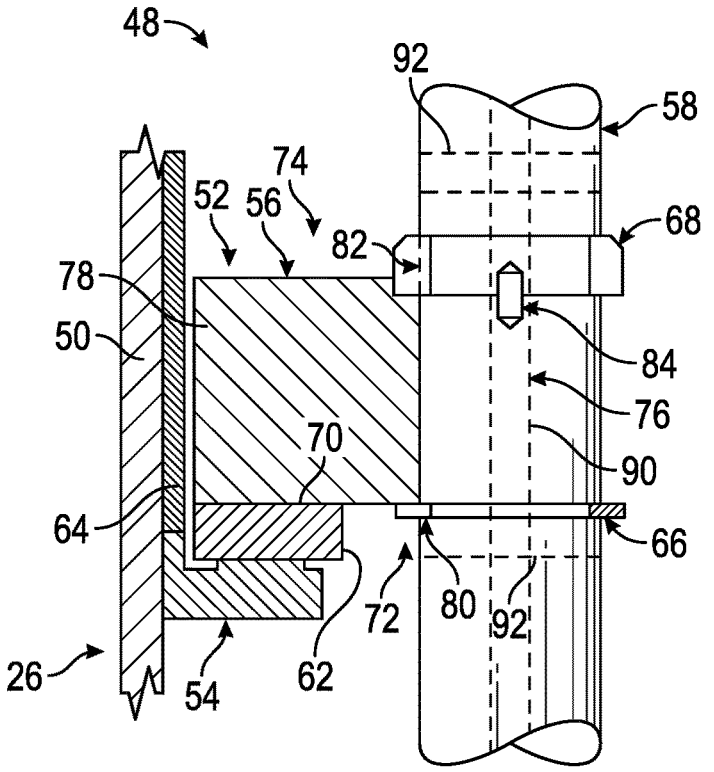
FIG. 5 is a partial cross-sectional view of another example of a thrust bearing system for use in a submersible pumping system component, according to an embodiment of the disclosure.

Referring generally to FIG. 5, another embodiment of thrust bearing system 48 is illustrated. In this example, passageway 76 is routed along a central region within shaft 58. According to an embodiment, the passageway 76 comprises an internal axial passage 90 extending along a central region of shaft 58. In some applications, the internal axial passage 90 is a central bore which runs generally parallel with the shaft 58 along the longitudinal axis of shaft 58. The internal axial passage 90 is placed in communication with lower region 72 and upper region 74 via lateral passages 92, e.g. radial passages, to enable the flow of gas from lower region 72 to upper region 74. In some embodiments, the lateral passages 92 may be canted with respect to a radial line so as to promote positive pumping of fluid, e.g. gas, from the lower region 72 to the upper region 74.

Figure 6:
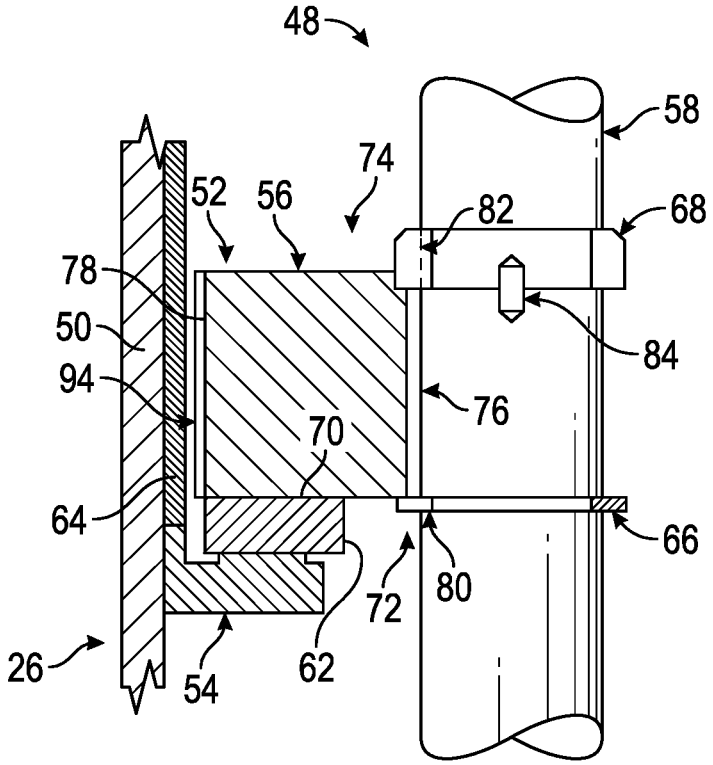
FIG. 6 is a partial cross-sectional view of another example of a thrust bearing system for use in a submersible pumping system component, according to an embodiment of the disclosure.

Referring generally to FIG. 6, another embodiment of the thrust bearing system 48 is illustrated. In this example, passageway 76 may be routed along a variety of pathways such as the illustrated channel along inner surface 86 of thrust runner 56. Additionally, the illustrated embodiment comprises an outer pumping feature 94, e.g. a groove, disposed along an outer region of the thrust runner 56. The groove may be in the form of a channel or of a space between sides of a vane or vanes disposed along the outer surface of the thrust runner 56 and extending from the lower region 72 to the upper region 74. The groove 94 may be a single groove or a plurality of grooves which work in cooperation with the passageway 76 to enable circulation of flow between the upper region and the lower region.

In this type of embodiment, the radially inward passageway 76 effectively pumps fluid/gas upwardly and the radially outward groove 94 enables recirculation of fluid flow back to the lower region 72. The circulation reduces resistance to upward fluid flow through passageway 76 and can increase the effectiveness of gas venting to the upper region 74. The radially outward groove 94 also may be angled from vertical, e.g. helically oriented, to further promote a pumping action with respect to the flowing fluid. In some embodiments, the outer pumping feature 94 may comprise features other than the illustrated groove and may include veins in the outer surface of the thrust runner 56 or holes near the outer surface of the thrust runner 56.

Figure 7:
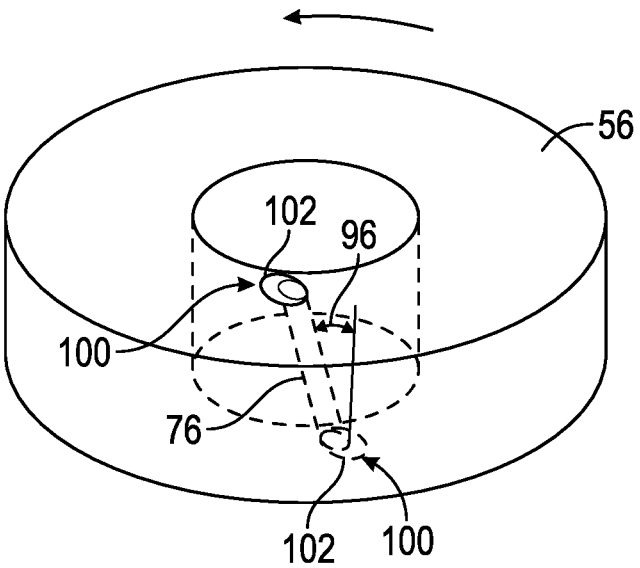
FIG. 7 is a schematic illustration of an example of a passageway with features to facilitate venting of gas from below a thrust runner, according to an embodiment of the disclosure.
Figure 8:
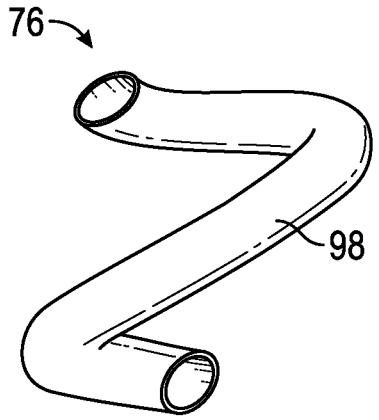
FIG. 8 is a schematic illustration of another example of a passageway configured to facilitate venting of gas from below a thrust runner, according to an embodiment of the disclosure.

The thrust bearing system 48 may utilize a variety of features to promote a pumping action and thus a flow of fluid along passageway 76. As illustrated in FIG. 7, the passageway 76 may be canted at an angle 96 with respect to an axial direction along a longitudinal axis of shaft 58. For example, the passageway 76 may comprise one or more vent holes canted outwardly from the shaft 58 such that the upper end of the passageway 76 is located radially outward relative to the lower end of the passageway 76. In some applications, the passageway 76 may be canted to follow a helical path 98, as illustrated in FIG. 8.

The features to facilitate flow also may comprise intake and/or discharge features 100 located at the intake and/or discharge ends of the passageway 76. Examples of intake and discharge features 100 may comprise enlarged openings 102. As illustrated, the enlarged openings 102 may be asymmetric or eccentric with respect to the passageway 76 and oriented to facilitate incoming and/or outgoing flow with respect to passage 76. The enlarged openings 102 also may be constructed in the form of protruding scoops to capture and direct fluid, e.g. gas, into the passageway 76 or to draw fluid out of the passageway 76. Features 100 also may comprise funnel shaped passages to concentrate fluid flow or other features which cooperate with passage 76 to facilitate the pumping action which moves fluid/gas from lower region 72 to upper region 74. As discussed above, the gas in upper region 74 may be directed to other locations within electric submersible pumping system 20 and/or to regions in the surrounding wellbore annulus. For example, the gas may be vented to the wellbore annulus by suitable components, such as a labyrinth chamber, a relief valve, a gravity separation chamber, or another suitable device.

In various embodiments described herein, the passageways 76 for venting gas from under the thrust runner 56 are located at a position radially inward of the inner diameter of thrust bearing 54. In other words, the passageway 76 is located at a smaller radius position relative to shaft 58 than the bearing surface being protected, e.g. radially inward from thrust bearing pad 62. The passageway 76 also may be canted or otherwise routed to facilitate a pumping action and/or to provide an unobstructed path for movement of gas from lower region 72 to upper region 74.

Depending on the application, the thrust bearing system 48 may be located in motor protector 26, submersible motor 22, and/or in another suitable pumping system component. Additionally, the thrust bearing system 48 may comprise various arrangements of components constructed from suitable materials to provide the desired support with respect to thrust loading during operation of the submersible pumping system. Various types of fastening mechanisms may be utilized in coupling the thrust runner to the shaft and in mounting the thrust bearing. Additionally, the passageway 76 may comprise a single vent path or a plurality of vent paths routed along the shaft 58 and/or thrust runner 56. Similarly, the submersible pumping system 20 may comprise many types of components in a variety of arrangements to enable pumping of desired fluids in a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in pumping fluids in a borehole, comprising:

an electric submersible pumping system comprising a submersible motor, a submersible pump powered by the submersible motor, a motor protector, and a thrust bearing system in the motor protector or submersible motor, the thrust bearing system comprising:

a thrust bearing;

a thrust runner mounted to a shaft and positioned adjacent the thrust bearing for rotation by the shaft relative to the thrust bearing, an upper region above the thrust runner being placed in communication with a lower region below the thrust runner via a passageway located at or proximate the shaft to vent gas away from the lower region; and a retention system configured to couple the thrust runner to the shaft, the retention system comprising one or more gaps in fluid communication with the passageway and configured to allow gas to flow from the lower region into the passageway and/or from the passageway into the upper region.

2. The system as recited in claim 1, wherein the passageway comprises an axial passageway extending through the thrust runner.

3. The system as recited in claim 1, wherein the passageway comprises an axial passageway extending along an interior of the shaft.

4. The system as recited in claim 1, wherein the passageway comprises a passageway formed as a channel in an outer surface of the shaft.

5. The system as recited in claim 1, wherein the passageway is canted to enhance a positive pumping action.

6. The system as recited in claim 1, wherein the passageway is helical.

7. The system as recited in claim 1, wherein the thrust runner comprises a pumping feature disposed along an outer surface of the thrust runner, the pumping feature working in cooperation with the passageway to enable circulation of fluid between the upper region and the lower region.

8. The system as recited in claim 7, wherein the pumping feature comprises a groove angled from vertical to promote a pumping action.

9. A system, comprising:

a motor protector having a shaft, a thrust bearing, and a thrust runner coupled to the shaft and rotatable by the shaft, the thrust runner being positioned entirely axially above and adjacent the thrust bearing to enable the thrust bearing to resist axial loading along the shaft, the motor protector venting gas accumulated in a region below the thrust runner via a passageway from the region below the thrust runner to a region above the thrust runner.

10. The system as recited in claim 9, wherein the passageway extends through the thrust runner from the region below the thrust runner to an upper region above the thrust runner.

11. The system as recited in claim 9, wherein the passageway extends along an interior of the shaft from the region below the thrust runner to an upper region about the thrust runner.

12. The system as recited in claim 9, wherein the passageway extends along an outer surface of the shaft from the region below the thrust runner to the region above the thrust runner.

13. The system as recited in claim 9, wherein the passageway is canted in a manner to facilitate a pumping action.

14. The system as recited in claim 9, wherein the passageway comprises an eccentric opening to facilitate a pumping action.

* * * * *